US011230997B1

(12) United States Patent
Viola et al.

(10) Patent No.: US 11,230,997 B1
(45) Date of Patent: Jan. 25, 2022

(54) METHOD AND SYSTEM FOR OPERATING A FUEL VAPOR CAPTURE SYSTEM OF AN AIR INTAKE SYSTEM OF AN INTERNAL COMBUSTION ENGINE

(71) Applicant: GM GLOBAL TECHNOLOGY OPERATIONS LLC, Detroit, MI (US)

(72) Inventors: Michael B. Viola, Macomb Township, MI (US); Darrell W. Burleigh, Fenton, MI (US); Timothy E. McCarthy, Grand Blanc, MI (US); Anne M. Dailly, West Bloomfield, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 17/176,662

(22) Filed: Feb. 16, 2021

(51) Int. Cl.
*F02M 25/08* (2006.01)
*F02M 35/10* (2006.01)
*F02M 31/135* (2006.01)

(52) U.S. Cl.
CPC .... *F02M 31/135* (2013.01); *F02M 35/10281* (2013.01)

(58) Field of Classification Search
CPC .. F02M 25/0854; F02M 25/089; F02M 25/08; F02M 35/10281; F02M 2025/0863; F02M 33/02
See application file for complete search history.

(56) References Cited

U.S. PATENT DOCUMENTS 4,403,587 A * 9/1983 Mizuno ..... F02M 25/0854 123/519
5,347,971 A * 9/1994 Kobayashi ..... F02M 25/0809 123/198 D
7,753,034 B2 * 7/2010 Hoke ..... B01D 53/02 123/519
9,050,885 B1 * 6/2015 Dudar ..... B60K 11/085
10,138,846 B1 * 11/2018 Dudar ..... F02M 25/0809
2002/0059920 A1 * 5/2002 Yoshioka ..... F02M 35/10019 123/518
2004/0211320 A1 * 10/2004 Cain ..... B29C 66/1122 96/108
2012/0024158 A1 * 2/2012 Makino ..... B01D 53/0438 96/154
2014/0076286 A1 * 3/2014 Karim ..... F02M 25/0836 123/520

(Continued)

OTHER PUBLICATIONS

Schneeman, Bon, Schwedler; Senkovska, Kaskel, Fischer; Flexible metal-organic frameworks;Royal Society of Chemistry 2014, 43, 6062-6096.

*Primary Examiner* — Long T Tran
(74) *Attorney, Agent, or Firm* — Quinn IP Law

(57) ABSTRACT

The concepts described herein provide for a method, apparatus and system to monitor and control a fuel vapor capture system that is disposed in an air intake system of an internal combustion engine for evaporative emission control. This includes an air intake system for an internal combustion engine that includes a fuel vapor capture system disposed in an interior portion of the air intake system, the fuel vapor capture system including a Metal Organic Framework (MOF) material that is configured to adsorb and desorb hydrocarbon vapor and a controllable device that is integrated into the fuel vapor capture system. In one embodiment, the MOF material is a flexible MOF material.

20 Claims, 5 Drawing Sheets

(56) References Cited

U.S. PATENT DOCUMENTS

| | | | | |
|---|---|---|---|---|
| 2015/0158378 | A1* | 6/2015 | Dudar | B60K 15/03519 701/22 |
| 2017/0023503 | A1* | 1/2017 | Rebinsky | G01N 25/18 |
| 2018/0363594 | A1 | 12/2018 | Byrne et al. | |
| 2020/0147586 | A1 | 5/2020 | Ruettinger et al. | |

* cited by examiner

METHOD AND SYSTEM FOR OPERATING A FUEL VAPOR CAPTURE SYSTEM OF AN AIR INTAKE SYSTEM OF AN INTERNAL COMBUSTION ENGINE

INTRODUCTION

A vehicle employing an internal combustion engine may emit volatile hydrocarbons from sources that may include an air intake system, a fuel delivery system, a fuel tank, and an exhaust gas recirculation (EGR) system. These emissions from the fuel tank and fuel delivery system may be captured employing an evaporative emissions control system that may include a canister that is filled with activated carbon.

New evaporative emission regulations for vehicles require control of emissions of substances, primarily hydrocarbons, from the vehicle under various vehicle operating conditions. By way of example, volatile hydrocarbons from several sources may collect in the air intake system during engine shutdown. There is a risk of such hydrocarbon leaking into the atmosphere during engine shutdown if not captured. An apparatus and system for capturing volatile hydrocarbons that may collect in the air intake system may be implemented in the intake air system. There is a need to control and monitor an apparatus and/or a system that is employed to capture volatile hydrocarbons that may collect in the air intake system.

SUMMARY

The concepts described herein provide for a method, apparatus and system to monitor and control a fuel vapor capture system that is disposed in an air intake system of an internal combustion engine for evaporative emission control.

An aspect of the disclosure includes an air intake system for an internal combustion engine that includes a fuel vapor capture system disposed in an interior portion of the air intake system, the fuel vapor capture system including a flexible Metal Organic Framework (MOF) material that is configured to adsorb and desorb hydrocarbon vapor and a controllable device that is integrated into the fuel vapor capture system. A controller is operatively connected to the controllable device, and includes an instruction set that is executable to activate the controllable device to control the flexible MOF material to the second state in response to a command to actively purge the fuel vapor capture system, determine an intake air purge flowrate and a total purge mass, and deactivate the controllable device when the total purge mass is greater than a purge mass threshold.

Another aspect of the disclosure includes the flexible MOF material being reversibly controllable in a first state and a second state, and is configured to adsorb hydrocarbon vapor in the first state and to desorb the hydrocarbon vapor in the second state.

Another aspect of the disclosure includes the instruction set being executable to monitor operation of the internal combustion engine and command the purge of the fuel vapor capture system when the operation of the internal combustion engine indicates that the engine is in a warmed up state.

Another aspect of the disclosure includes the instruction set being executable to control activation of the controllable device of the fuel vapor capture system when the operation of the internal combustion engine indicates that the engine is in a warmed up state. The warmed up state of the engine may be indicated by coolant temperature, engine oil temperature, catalyst temperature, etc.

Another aspect of the disclosure includes the instruction set being executable to control a magnitude of activation of the controllable device in relation to the monitored operation of the internal combustion engine.

Another aspect of the disclosure includes the instruction set being executable to monitor an activation parameter for the controllable device, and deactivate the controllable device when the activation parameter is greater than a second threshold.

Another aspect of the disclosure includes the controllable device integrated into the fuel vapor capture system being a heating element that is arranged proximal to the flexible MOF material, wherein the instruction set controls the heating element in a heat generating state.

Another aspect of the disclosure includes the heating element being one of a positive temperature coefficient (PTC) heater, a thin film heater, or a rod heater.

Another aspect of the disclosure includes the instruction set being executable to determine an integrated activation energy parameter for the controllable device based upon the activation parameter to detect a fault associated with the controllable device. A fault is detected when the integrated activation energy parameter for the controllable device is either greater than an upper threshold or less than a lower threshold.

Another aspect of the disclosure includes a sensing element that is arranged to monitor an element of the fuel vapor capture system and is in communication with the controller. The sensing device is monitored to detect a fault associated with the on-vehicle fuel vapor capture system.

Another aspect of the disclosure includes the sensing element being arranged to monitor an electrical circuit of the fuel vapor capture system to detect one of an open circuit or a short circuit in the electrical circuit of the fuel vapor capture system.

Another aspect of the disclosure includes the sensing element being arranged to monitor a position associated with the flexible MOF material to detect a fault in the flexible MOF material based upon the position.

Another aspect of the disclosure includes the sensing element being arranged to monitor a temperature associated with the flexible MOF material to detect a fault in the flexible MOF material based upon the temperature.

Another aspect of the disclosure includes the sensing element being arranged to monitor a pressure associated with the flexible MOF material to detect a fault in the flexible MOF material based upon the pressure.

Another aspect of the disclosure includes the sensing element being arranged to monitor a purge time associated with the fuel vapor capture system to detect a fault in the flexible MOF material based upon the purge time.

Another aspect of the disclosure includes an air intake system for an internal combustion engine that includes a fuel vapor capture system disposed in an interior portion of the air intake system, the fuel vapor capture system including a Metal Organic Framework (MOF) material, the MOF material configured to adsorb and desorb hydrocarbon fuel vapor. A controllable device is integrated into the fuel vapor capture system. A controller is operatively connected to the controllable device and includes an instruction set that is executable to activate the controllable device in response to a command to actively purge the fuel vapor capture system, determine an intake air purge flowrate and a total purge mass, and deactivate the controllable device when the total purge mass is greater than a purge mass threshold.

Another aspect of the disclosure includes a method for operating an on-vehicle fuel vapor capture system arranged in an air intake system of an internal combustion engine, the fuel vapor capture system arranged to capture fuel vapors from the internal combustion engine, wherein the fuel vapor capture system is composed of a flexible Metal Organic Framework (MOF) material that is coupled to a controllable device. The method includes monitoring operation of the internal combustion engine, activating the controllable device and determining an activation parameter for the controllable device, determining an intake air purge flowrate and a total purge mass, and deactivating the controllable device when the total purge mass is greater than a threshold.

The fuel vapor capture system is arranged in an interior portion of an air intake system for an internal combustion engine. The vapor capture element is fabricated from a flexible Metal Organic Framework (MOF) material, wherein the flexible MOF material is a bistable material that is reversibly controllable to a first state and to a second state in response to a control stimulus. The flexible MOF material is able to adsorb hydrocarbon vapor when in the first state and able to desorb the hydrocarbon vapor when in the second state. The flexible MOF material is capable of adsorbing and desorbing hydrocarbon vapors in the air intake system. The vapor capture element is tunable for a specific system and is actively controllable in-use. Flexible MOFs are able to change their pore dimensions and/or other adsorption and desorption capabilities in response to an external stimulus to selectively adsorb and desorb hydrocarbon vapor components in the air intake system.

The above summary is not intended to represent every possible embodiment or every aspect of the present disclosure. Rather, the foregoing summary is intended to exemplify some of the novel aspects and features disclosed herein. The above features and advantages, and other features and advantages of the present disclosure, will be readily apparent from the following detailed description of representative embodiments and modes for carrying out the present disclosure when taken in connection with the accompanying drawings and the claims.

BRIEF DESCRIPTION OF THE DRAWINGS

One or more embodiments will now be described, by way of example, with reference to the accompanying drawings, in which.

Figure 1:
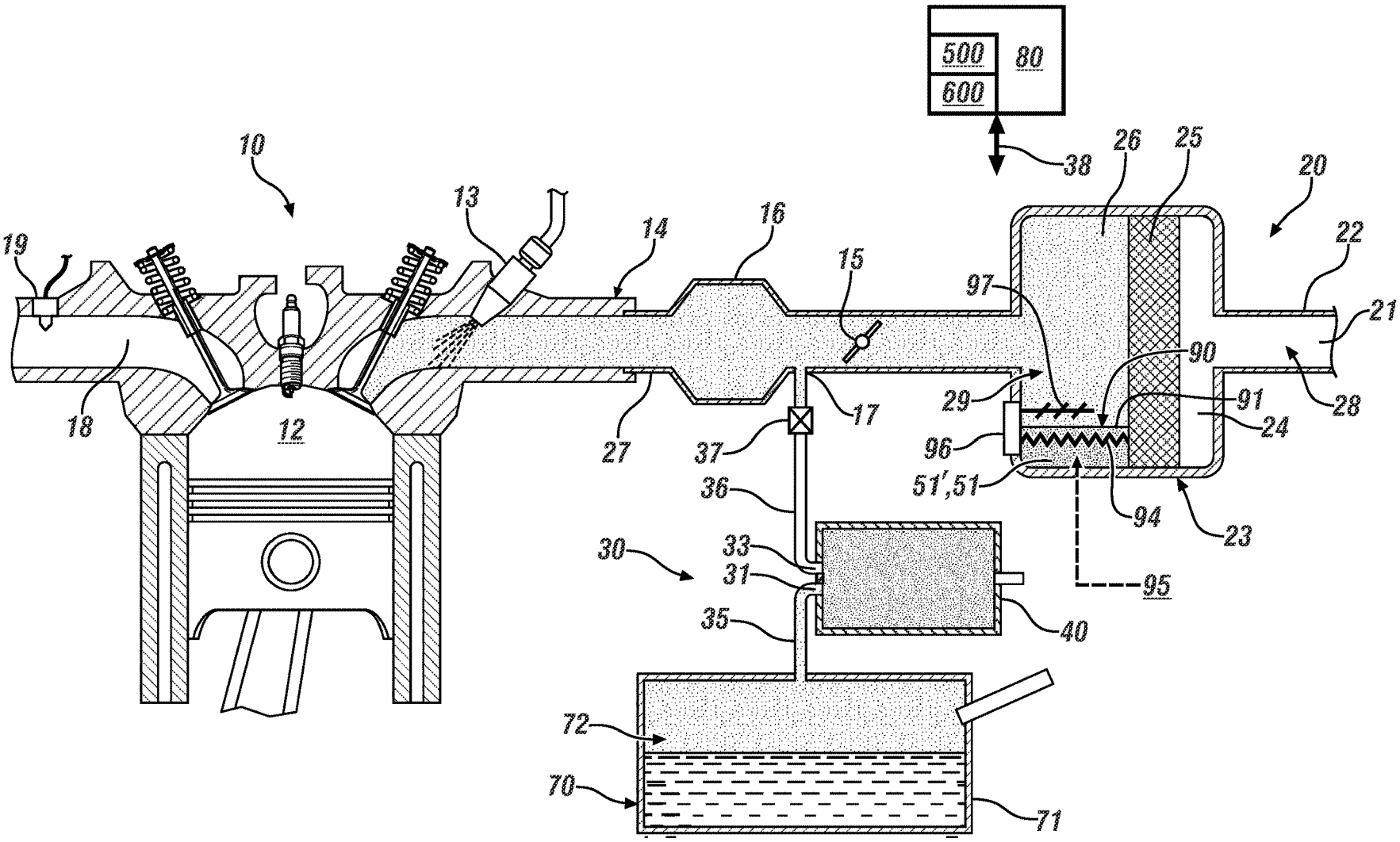
FIG. 1 schematically illustrates portions of an internal combustion engine and evaporative emissions system having a vapor capture element fabricated from a flexible Metal Organic Framework (MOF) material, in accordance with the disclosure.

The appended drawings are not necessarily to scale, and may present a somewhat simplified representation of various preferred features of the present disclosure as disclosed herein, including, for example, specific dimensions, orientations, locations, and shapes. Details associated with such features will be determined in part by the particular intended application and use environment.

DETAILED DESCRIPTION

The components of the disclosed embodiments, as described and illustrated herein, may be arranged and designed in a variety of different configurations. Thus, the following detailed description is not intended to limit the scope of the disclosure, as claimed, but is merely representative of possible embodiments thereof. In addition, while numerous specific details are set forth in the following description to provide a thorough understanding of the embodiments disclosed herein, some embodiments can be practiced without some of these details. Moreover, for the purpose of clarity, certain technical material that is understood in the related art has not been described in detail to avoid unnecessarily obscuring the disclosure. Furthermore, the disclosure, as illustrated and described herein, may be practiced in the absence of an element that is not specifically disclosed herein. Furthermore, there is no intention to be bound by any expressed or implied theory presented in the preceding background, summary or the following detailed description. Throughout the drawings, corresponding reference numerals indicate like or corresponding parts and features.

As used herein, the term "system" may refer to one of or a combination of mechanical and electrical actuators, sensors, controllers, application-specific integrated circuits (ASIC), combinatorial logic circuits, software, firmware, and/or other components that are arranged to provide the described functionality.

As employed herein, the term "upstream" and related terms refer to elements that are towards an origination of a flow stream relative to an indicated location, and the term "downstream" and related terms refer to elements that are away from an origination of a flow stream relative to an indicated location.

Figure 2:
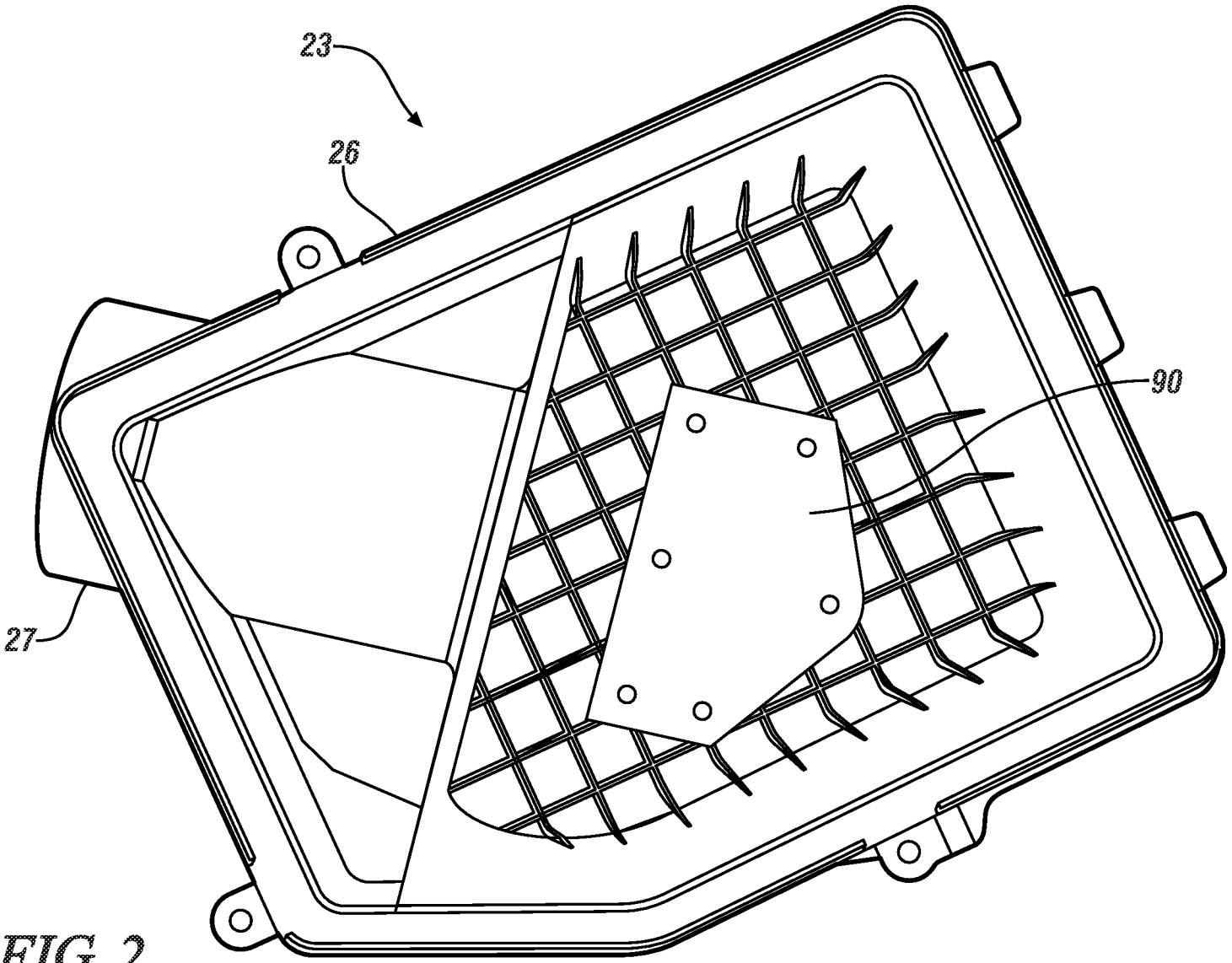
FIG. 2 schematically illustrates a portion of an air filter system including a filtered air housing of an air filter housing and a vapor capture element that is fabricated from a flexible MOF material, in accordance with the disclosure.

Referring to the drawings, wherein like reference numerals correspond to like or similar components throughout the several Figures, FIGS. 1 and 2, consistent with embodiments disclosed herein, schematically illustrate a portion of a multi-cylinder internal combustion engine 10 and fuel storage system 70 for a vehicle that includes an embodiment of a vapor capture element 90. The vehicle may include, but not be limited to a mobile platform in the form of a commercial vehicle, industrial vehicle, agricultural vehicle, passenger vehicle, aircraft, watercraft, train, all-terrain vehicle, personal movement apparatus, robot and the like to accomplish the purposes of this disclosure.

The illustrated portion of the internal combustion engine 10 includes a single combustion chamber 12 that is fluidly coupled to an air intake system 20, an intake manifold 14, and an exhaust manifold 18. Elements of the internal combustion engine 10 include a fuel injector 13, throttle 15, air flow sensor 16, and exhaust sensor 19. The air intake system 20 includes a fresh air inlet 21 fluidly coupled to the intake manifold 14 via a fresh air duct 22, an air filter housing 23, and an intake manifold duct 27. The air filter housing 23 includes an inlet housing 24, an air filter element 25 and a filtered air housing 26. The fresh air inlet 21, fresh air duct 22, and inlet housing 24 of the air filter housing 23 form a fresh air side 28. The filtered air housing 26 of the air filter housing 23, the intake manifold duct 27, and the intake manifold 14 form a filtered air side 29. The fuel vapor capture system 90 is disposed in the filtered air housing 26 of the air filter housing 23 on the filtered air side 29 between the air filter element 25 and the intake manifold 14.

The internal combustion engine 10 as shown is configured as a spark-ignition internal combustion engine with port fuel injection. The concepts described herein are not limited to such a configuration, and may instead be employed on another form of fuel injection, such as but not limited to a direct-injection system. Furthermore, the concepts described herein may also be applied to a compression-ignition engine.

The fuel storage system 70 includes a fuel storage tank 72 and an evaporative storage canister 40. The fuel storage system 70 supplies fuel via a fuel pump to an engine fuel distribution system that fluidly couples to engine fuel injectors, including illustrated fuel injector 13. The fuel storage tank 72 is fluidly coupled to an input port 31 of the evaporative storage canister 40 via a vapor line 35. The evaporative storage canister 40 is fluidly coupled to the air intake system 20 via a purge line 36 and a purge valve 37. The purge line 36 is fluidly coupled to the air intake system 20 on the filtered air side 29 at input port 17 downstream of the throttle 15 at or near the intake manifold 14.

A controller 80 is arranged to control operation of the internal combustion engine 10, including controlling elements of the evaporative emission system 30. The controller 80 is in communication with or operatively connected to various elements via an electrical circuit 38 that includes one or more of electrical power cables and a communication link. The controller 80 is also in communication with and/or operatively connected to elements associated with the fuel vapor capture element 90, through which the controller 80 communicates an activation parameter in the form of control stimulus 95 to effect fuel vapor adsorption and fuel vapor desorption in the vapor capture element 90, in one embodiment. The controller 80 includes an intake air vapor capture system control algorithm ("control algorithm") 500 that is described with reference to FIG. 5, and an intake air vapor capture system monitoring algorithm ("monitoring algorithm") 600 that is described with reference to FIG. 6.

One element that may be associated with the fuel vapor capture system 90 is a controllable device 94 that is integrated into or closely proximal thereto. In one embodiment, the controllable device 94 is a heating element that can be controlled in a fully-on state or a partially-on state to generate heat that is transferable to the fuel vapor capture system 90, or an off state. Another element that may be associated with the fuel vapor capture system 90 is a controllable airflow diverter 97 that is arranged adjacent to the fuel vapor capture system 90. The controllable airflow diverter 97 can be controlled to a first state to divert a portion of intake airflow towards the fuel vapor capture system 90 to facilitate vapor capture and purge, and a second state to divert intake airflow away from the fuel vapor capture system 90. In one embodiment, the controllable airflow diverter 97 can be controlled to a position that is infinitely variable between the first state and the second state to divert a portion of intake airflow towards the fuel vapor capture system 90.

The fuel vapor capture system 90 is fabricated from Metal Organic Framework (MOF) material 51 that is capable of adsorbing and desorbing hydrocarbon material. Alternatively, the fuel vapor capture system 90 is fabricated from a flexible Metal Organic Framework (MOF) material 51' that is capable of adsorbing and desorbing hydrocarbon material. Flexible MOF material 51' is a bistable, reversibly controllable material that is described with reference to FIGS. 3 and 4. In one embodiment, the fuel vapor capture system 90 is formed by arranging the MOF material 51 with a binder material. In one embodiment, the fuel vapor capture system 90 is formed by depositing the MOF material 51 onto a substrate. In one embodiment, the fuel vapor capture system 90 is formed by integrating the MOF material 51 into a thin film. In one embodiment, the fuel vapor capture system 90 is formed by containing the MOF material 51 into a sealed pouch, wherein the sealed pouch is fabricated with material that is porous to hydrocarbons.

In one embodiment, the fuel vapor capture system 90 is arranged as a sheet with a flat planar surface. Alternatively, the fuel vapor capture system 90 may be arranged as a sheet having a surface contour that is tubular, coiled, or wavy. Alternatively, the fuel vapor capture system 90 may be arranged in a honeycombed surface. In one embodiment, the honeycombed surface may be oriented orthogonal to the direction of air flow. Alternatively, the fuel vapor capture system 90 may be arranged as a sheet having a surface contour that is discontinuous, such as having a W-shape, a V-shape, an L-shape, an I-shape, a box shape, etc.

The fuel vapor capture system 90 is disposed in an interior portion of the air filter housing 23 on the filtered air side 29, i.e., downstream of the air filter element 25. The fuel vapor capture system 90 may be arranged as a flat planar sheet that is disposed in the filtered air housing 26 of the air filter housing 23 and affixed to a surface such as an interior wall. This arrangement is shown with reference to FIG. 2. In one embodiment, the fuel vapor capture system 90 may be arranged as a flat planar sheet that is disposed in and affixed to the air filter element 25 in the filtered air housing 26 of the air filter housing 23. This arrangement is shown with reference to FIG. 1. Alternatively, the fuel vapor capture system 90, when arranged with a planar surface, may be disposed in the interior portion of the air intake system 20 on the filtered air side 29, i.e., downstream of the air filter element 25 and with the planar orientation being disposed in parallel to a direction of an airflow path in the air intake system 20. In this embodiment, the fuel vapor capture system 90 may be centrally arranged in the filtered air housing 26 of the air filter housing 23 or the intake manifold duct 27. Alternatively, there may be multiple fuel vapor capture systems 50 that are disposed in individual runners of the intake manifold 14.

The air intake system 20 for the internal combustion engine 10 includes the fuel vapor capture system 90 that is disposed in an interior portion of the air intake system 20, and the controller 80.

The controller 80 is operatively connected to the fuel vapor capture system 90. The controller generates the activation parameter, i.e., control stimulus 95 that is communicated to the fuel vapor capture system 90. The control stimulus 95 includes a first state and a second state, in one embodiment. In one embodiment, the control stimulus 95 is indirectly generated by one or more engine operating conditions and/or vehicle operating conditions. In such embodiments, the control stimulus 95 may be one or a combination of a partial pressure, or an ambient temperature, or a light intensity. The control stimulus 95 includes first state and second state, and may be a constant signal, a pulsewidth-modulated signal or another modulated signal in the form of electrical voltage, electrical current, electro-magnetic pulse, emitted light, pressure, etc., without limitation.

A MOF sensor 96 is integrated to the fuel vapor capture system 90 to monitor the MOF material 51 and communicates with the controller 80. In one embodiment, the MOF sensor 96 is an electrical sensor that monitors electrical resistance or conductance across all or a portion of the MOF material 51. In one embodiment, the MOF sensor 96 is a differential pressure sensor that monitors a differential pressure across all or a portion of the MOF material 51. In one embodiment, the MOF sensor 96 is a temperature sensor that monitors a temperature of the MOF material 51. In one embodiment, the MOF sensor 96 includes multiple temperature sensors that monitor a differential temperature across all or a portion of the MOF material 51.

The flexible MOF material 51' is a class of MOF material that exhibits a dynamic change of pore dimensions in response to an external stimulus. In accordance with the construction natures and features, the flexible MOF material 51 can show diverse types and magnitudes of structural dynamism. This many include expansion and contraction of pore diameter, also known as a breathing mechanism. The breathing mechanism may be triggered by external chemical stimuli, e.g., guest adsorption, desorption, and exchange. The breathing mechanism may instead be triggered by external physical stimuli, e.g., a change in temperature, light, and/or pressure.

The flexible MOF material 51' has the characteristics of framework flexibility and dynamic response, which distinguishes it from other porous materials such as zeolites and activated carbons. The flexible MOF material 51' has an intrinsic ability to show different structural transformations or dynamic behaviors in response to the control stimulus 95.

The flexible MOF material 51' is reversibly controllable in a first state and a second state in response to the control stimulus 95. The flexible MOF material 51' is configured to adsorb hydrocarbon vapor when controlled to the first state and configured to desorb hydrocarbon vapor when controlled to the second state.

The flexible MOF material 51' is configured to transform to have tightly arranged, small pores that are capable of adsorbing the hydrocarbon fuel vapor when the control stimulus 95 is in the first state. Volatile hydrocarbon fuel vapor that is contained within the filtered air side 29 of the air intake system 20 may precipitate onto the fuel vapor capture system 90 and/or be adsorbed by the flexible MOF material 51 during an engine off state when the flexible MOF material 51' is controlled by the control stimulus to the first state.

The flexible MOF material 51' is configured to transform to have loosely arranged, large pores capable of desorbing hydrocarbon vapor when the control stimulus 95 is in the second state. The hydrocarbon vapor that is adsorbed by the flexible MOF material 51 during an engine-off state may be desorbed by the flexible MOF material 51 during an engine on state when the flexible MOF material 51 is controlled by the control stimulus 95 to the second state.

The flexible MOF material 51' may be one of or a combination of MIL-53 Al, MIL-88 series, ZIF-8, and/or Co(bdp). MIL-53 Al is an aluminum terephthalate MOF; MIL-88 series is an iron (III) dicarboxylate MOF; ZIF-8 is an zeolitic imidazolate framework that is made by zinc ions that are coordinated by four imidazolate rings; and Co(bdp) is a cobalt-based MOF with $bdp^{2-}$=1,4-benzenedipyrazolate linker.

Figure 3:
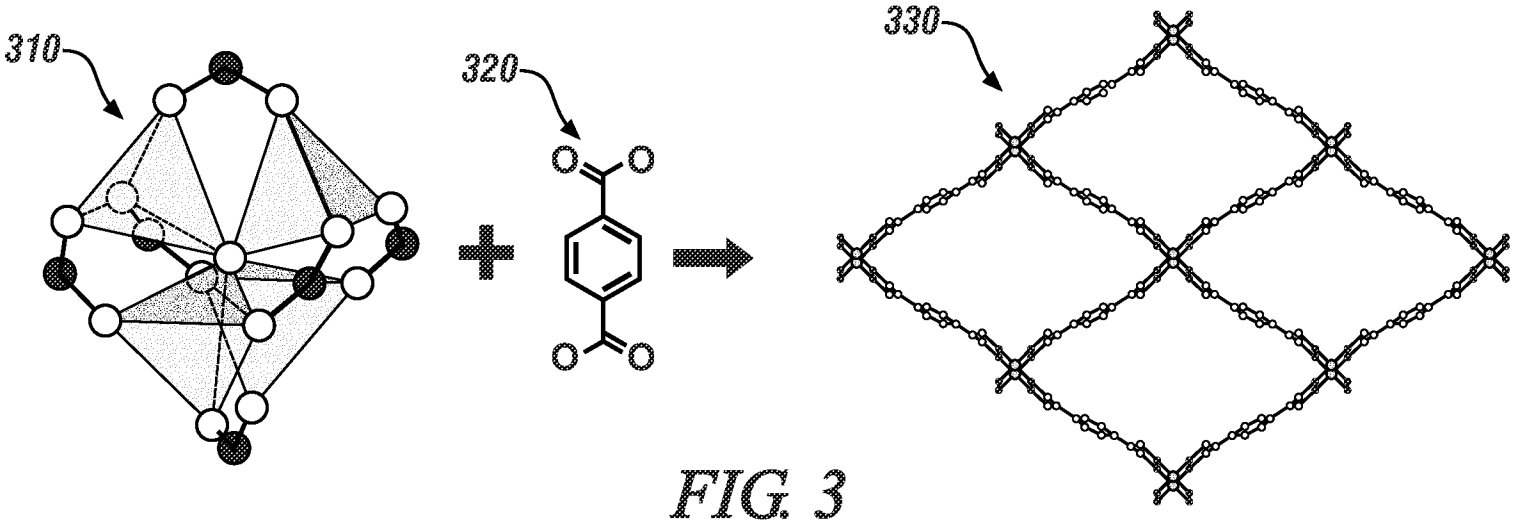
FIG. 3 pictorially shows an example flexible MOF material, in accordance with the disclosure.

FIG. 3 pictorially shows an example of a flexible MOF 330. e.g., an embodiment of the flexible MOF material 51' of FIG. 1. The flexible MOF 330 is a hybrid organic-inorganic material that is assembled by connection of Secondary Building Blocks (SBU) 310 through rigid organic ligands 320. In one embodiment, the SBU 310 includes metal oxide clusters. The flexible MOF 330 may also be described as having interchangeable metal-containing nodes and carbon-based struts. Pore sizes and their chemical functionality can be tailored through control of the architecture, including being tailored to adsorb specific hydrocarbon molecules.

Figure 4:
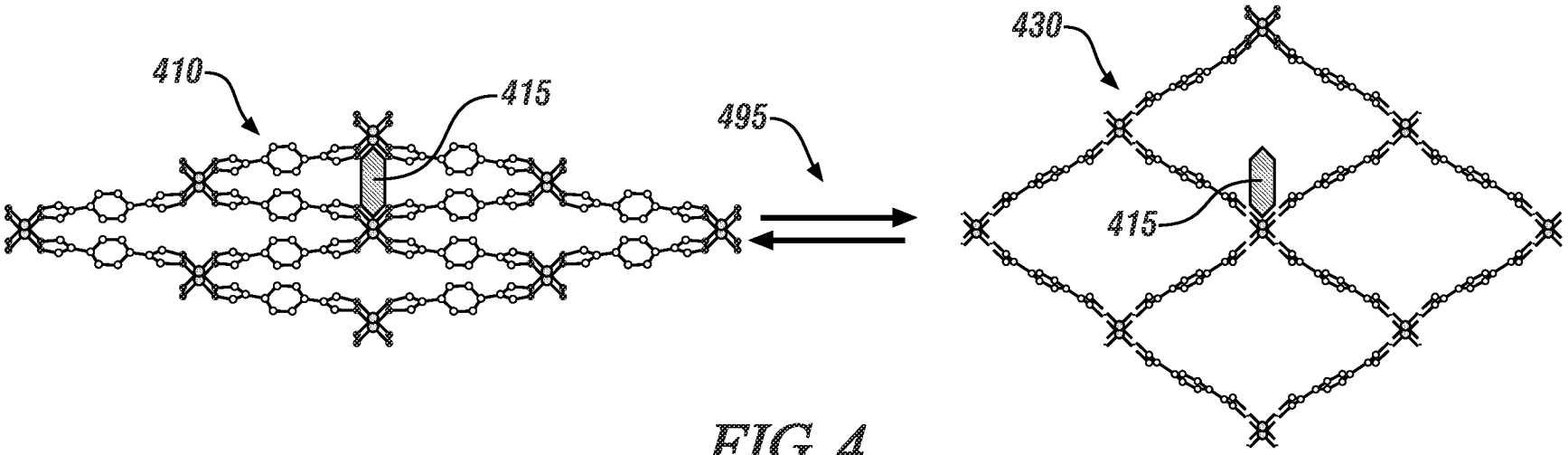
FIG. 4 pictorially illustrates a portion of an example flexible MOF material in a first, collapsed state and in a second, expanded state, and an associated control stimulus, in accordance with the disclosure.

FIG. 4 pictorially illustrates a portion of an embodiment of flexible MOF material, e.g., Co(bdp), in a first, collapsed state 410 and in a second, expanded state 410, and an associated control stimulus 495. The flexible MOF material is reversibly controllable to a first state and to a second state in response to the control stimulus 495. As illustrated, the flexible MOF material is transformable to have tightly arranged, small pores that are capable of adsorbing hydrocarbon vapor when commanded to the first, collapsed state 410 by the control stimulus 495. As illustrated, the flexible MOF material is transformable to have loosely arranged, large pores that are capable of desorbing hydrocarbon vapor when commanded to the second, expanded state 430 by the control stimulus 495.

Referring again to FIG. 1, the flexible MOF material 51' may be arranged to be pressure-responsive, photo-responsive, thermo-responsive, or a combination, in one embodiment. The flexible MOF material 51' may instead be arranged to be responsive to mechanical deformation. Flexible MOFs have intrinsic abilities to show different structural transformations or dynamic behaviors toward external stimuli. Flexible MOFs that can store greater amount of hydrocarbon vapors than similarly sized (by volume) devices employed activated carbon.

The use of a flexible MOF as described herein allows tuning of the pore aperture size for adsorption and for desorption to achieve the desired properties for selectively adsorbing and desorbing desired components of a gas mixture, e.g., VVOCs such as n-butane.

Figure 5:
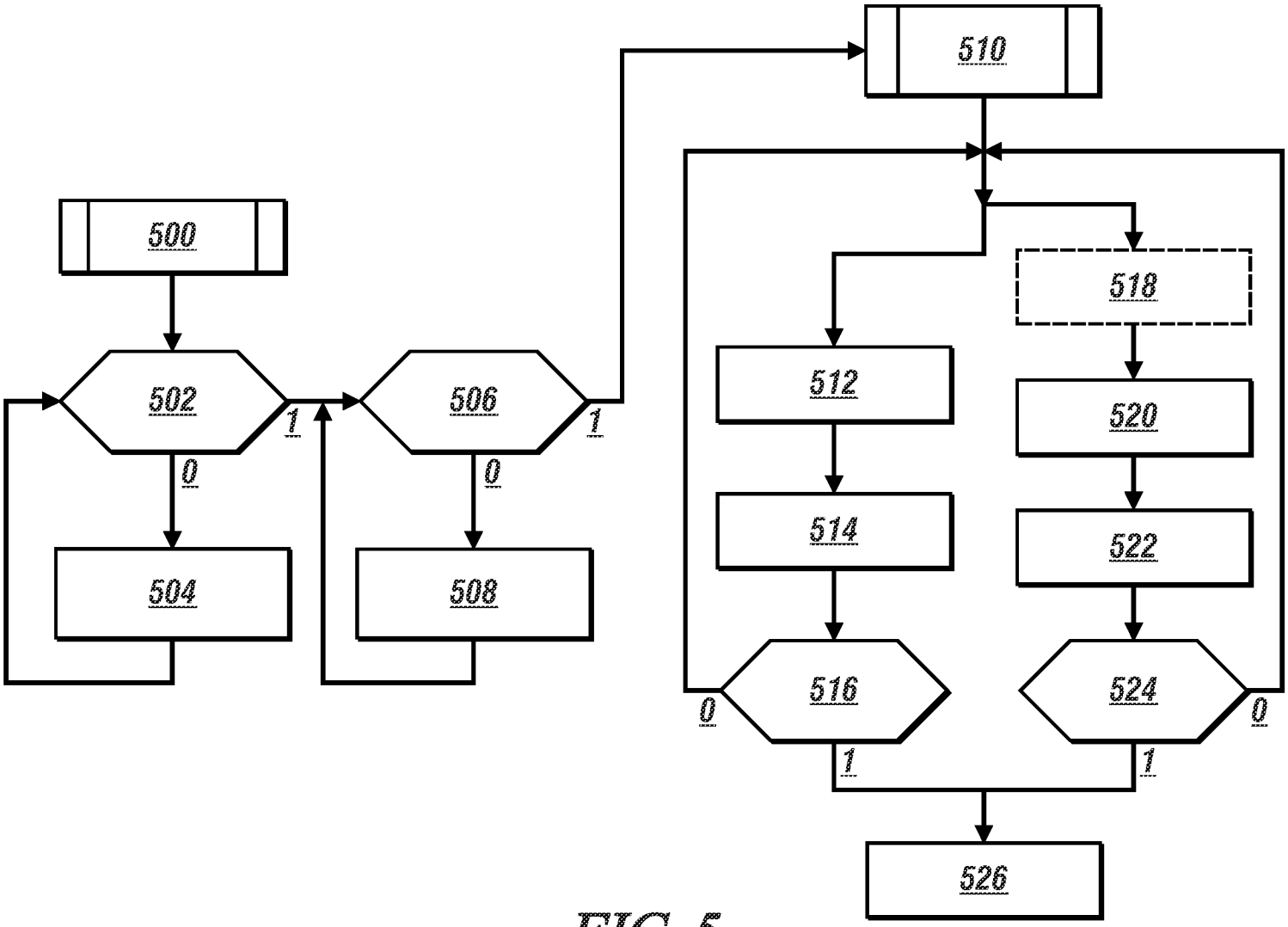
FIG. 5 schematically illustrates a flowchart of an intake air vapor capture system control algorithm for controlling an embodiment of the internal combustion engine and evaporative emissions system that is described with reference to FIG. 1, in accordance with the disclosure.

FIG. 5 schematically illustrates a flowchart of an intake air vapor capture system control algorithm ("control algorithm") 500, executable in the controller 80, for controlling an embodiment of a vehicle that includes an embodiment of the internal combustion engine 10 and the fuel vapor capture system 90 that are described with reference to FIG. 1. The fuel vapor capture system 90 includes controllable device 94, which is a heating element that is adjacent to or integrated into the MOF material 51 in one embodiment, and/or an airflow diverter 97 that is controllable to divert intake airflow towards the MOF material 51. The MOF material 51 includes the flexible MOF material 51'. The controller 80 includes an instruction set in the form of the control algorithm 500 that is executable to activate the controllable device 94 and control the airflow diverter 97 in response to a command to actively purge the fuel vapor capture system 90.

Details of the control algorithm 500 include as follows. The control algorithm 500 monitors vehicle operation to detect occurrence of a key-on event, i.e., some indication by a vehicle operator that they intend to operate the vehicle (502). If there is no key-on event (502)(0), the fuel vapor capture system 90 including the controllable device 94 and hence the first adsorbent material 51 including the MOF material 51 are controlled to the first state via the control stimulus 95 (504) to facilitate hydrocarbon adsorption. In one embodiment, the first state is a default state. In response to a key-on event (502)(1), it is determined whether a purge event is enabled (506). This includes, by way of non-limiting examples, evaluating operation of the internal combustion engine 10 to determine if it is able to manage operation with a flow of additional hydrocarbons originating from the fuel vapor capture system 90. Such evaluation can include determining that the engine 10 is in a warmed up condition, determining that an exhaust aftertreatment system is capable of managing additional hydrocarbons, etc. Purge enable criteria and associated engine operating criteria are system-specific and are known. When the purge enable criteria are not met (506)(0), the fuel vapor capture system 90 including the controllable device 94 and hence the first adsorbent material 51 including the MOF material are controlled to the first state via the control stimulus 95 (508).

When the purge enable criteria are met (506)(1), a purge routine 510 is executed to purge fuel vapor from the fuel vapor capture system 90.

The purge routine 510 includes commanding, via the control stimulus 95, operation of the controllable device 94 to activate the MOF material 51 to facilitate hydrocarbon desorption therefrom (512). This includes, in one embodiment, activating the heating element to control the first adsorbent material 51 including the MOF material The activation parameter is an estimate of MOF activation energy that is commanded by the control stimulus 95 and indicates power to the MOF, whether in the form of electrical power, heat energy, conductance, differential pressure, etc.

The activation energy associated with commanding operation of the controllable device 94 via the control stimulus 95 is monitored or otherwise determined, and is integrated over time (514). When the integrated activation energy is less than a calibrated threshold value (516)(0), operation continues. When the integrated activation energy is greater than the calibrated threshold value (516)(1), the control stimulus 95 for controlling operation of the controllable device 94 is deactivated or otherwise discontinued (526).

Coincident with commanding operation of the controllable device 94 via the control stimulus 95 (Steps 512, 514, 516), the controllable airflow diverter 97 that is arranged adjacent to the fuel vapor capture system 90 can be controlled to a first state to divert a portion of intake airflow towards the fuel vapor capture system 90 on systems that employ the controllable airflow diverter 97 (518). Engine operation is monitored to estimate an intake air purge flowrate (520) based upon inputs from the air flow sensor 16, and the exhaust sensor 19, and a total purge mass is determined by executing a time-integration of the estimated intake air purge flowrate (522). The total purge mass is compared to a threshold purge mass (524). This operation continues while the integrated intake air purge mass is less than the threshold intake air purge mass (524)(0). When either the total purge mass is greater than the threshold purge mass (524)(1) or the time-integrated magnitude of activation energy input to the MOF material is greater than the energy threshold (516)(1), the control stimulus 95 for controlling operation of the controllable device 94 is deactivated or otherwise discontinued (526). The controllable airflow diverter 97 may continue to be activated to permit air flow through the fuel vapor capture system 90 during the key-on event, unless other factors cause it to be deactivated.

Figure 6:
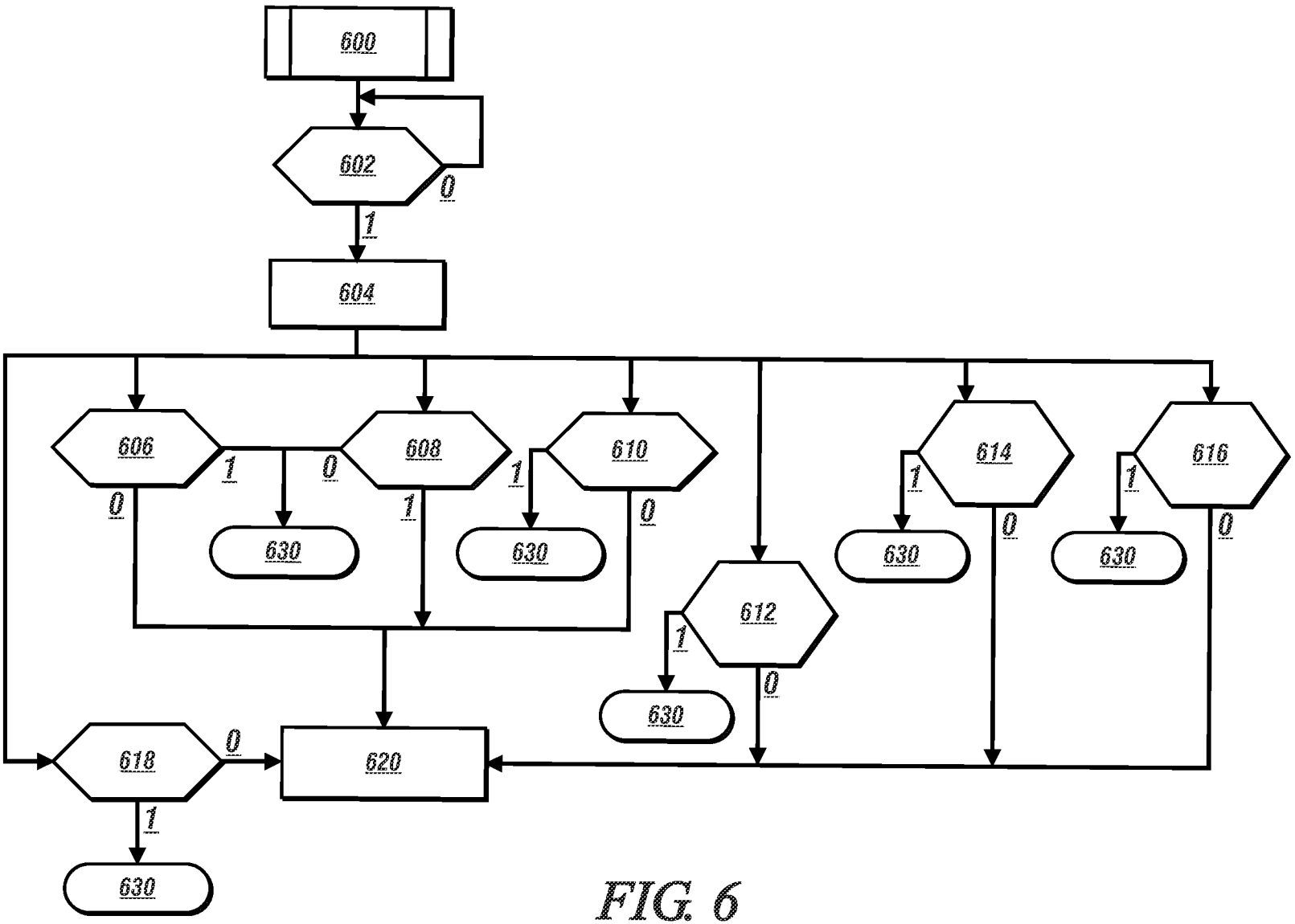
FIG. 6 schematically illustrates a flowchart of an intake air vapor capture system monitoring algorithm for monitoring an embodiment of the internal combustion engine and evaporative emissions system that is described with reference to FIG. 1, in accordance with the disclosure.

FIG. 6 schematically illustrates a flowchart of an intake air vapor capture system monitoring algorithm ("monitoring algorithm") 600 that is executable in the controller 80 to monitor an embodiment of vehicle that includes an embodiment of the internal combustion engine 10 and the fuel vapor capture system 90 arranged in the air intake system 20 that are described with reference to FIGS. 1, 2 and 4. The monitoring algorithm 600 seeks to detect occurrence of a fault in the fuel vapor capture system 90 that is arranged to capture fuel vapors in the air intake system 20 and is fluidly coupled to the intake manifold 14 of the internal combustion engine 10. The fuel vapor capture element 90 has the first adsorbent material 51 in the form of MOF material. In one embodiment, the MOF material 51 disposed in the chamber is a flexible MOF material, e.g., as described herein. The controllable device, e.g., device 94 is coupled to the MOF material. The controller 80 is operatively connected to the controllable device 94 and the airflow diverter 97, and in communication with various sensors via the electrical circuit 38. The controller 80 includes an instruction set in the form of the monitoring algorithm 600.

Details of the monitoring algorithm 600 include as follows. The monitoring algorithm 600 executes during engine operation when enable criteria have been met (602)(1). Enable criteria can include achieving selected states for engine operating parameters, absence of related faults, and other criteria. When the enable criteria are not met (602)(0), execute of the monitoring algorithm 600 is postponed.

The monitoring algorithm 600 includes regular and/or periodic monitoring of inputs from on-vehicle sensors, timers, control routines, etc. The inputs include, e.g., signal inputs from the control stimulus 95, an activation signal to the airflow diverter 97, engine operation from the exhaust sensor 19, position sensor 415 that is arranged to monitor the flexible MOF material, the MOF sensor 96, etc.

The monitoring algorithm 600 includes executing a plurality of diagnostic monitoring algorithms to evaluate elements of the fuel vapor capture system 90 and the internal combustion engine 10. Exemplary diagnostic monitoring algorithms include a power rationality check 606, an open circuit/short circuit check 608, a MOF device position rationality check 610, a MOF parameter check 612, a purge rationality check 614, a vapor flow rationality check 616, and/or an airflow diverter 97 position check 618.

The power rationality check 606 indicates whether the power consumed in response to the control stimulus 95, integrated over its operation, is within an allowable maximum and minimum power range. The allowable maximum and minimum power range is associated with expected power needs to purge the fuel vapor capture system 90 of hydrocarbon vapor by activation of the MOF material 51 via the control stimulus 95. The power rationality check 606 indicates absence of a fault (630) when the integrated power is within the allowable maximum and minimum power range (606)(1). The power rationality check 606 indicates occurrence of a fault (620) when the integrated power is outside the allowable maximum and minimum power range (606)(0).

The open circuit/short circuit check 608 an electrical check of the elements of the electrical circuit 38 that are related to actuators and sensors employed by the fuel vapor capture system 90, including, e.g., the control stimulus 95, the airflow diverter 97, etc. The electrical check of the elements of the electrical circuit 38 include a check for occurrence of short circuits or open circuits. The open circuit/short circuit check 608 indicates absence of a fault (630) when no short circuits or open circuits in the electrical circuit 38 are detected (608)(1). The open circuit/short circuit check 608 indicates a potential occurrence of a fault (620) when either a short circuit or an open circuit in the electrical circuit 38 is detected (608)(0).

The device position rationality check 610 monitors the signal input from the position sensor 415 that integrated into the flexible MOF material 51' to determine whether the flexible MOF material 51' is in a position that is consistent with the command position as indicated by the control stimulus 95. For example, when the control stimulus 95 commands the flexible MOF material 51' to the first state, the position sensor 415 indicates that the flexible MOF material 51' has tightly arranged, small pores that are capable of adsorbing hydrocarbon vapor. When the control stimulus 95 commands the flexible MOF material to the second state, the position sensor 415 indicates that the flexible MOF material 51' has large pores that are capable of desorbing hydrocarbon vapor. The device position rationality check 610 indicates absence of a fault (630) when the position sensor 415 indicates the flexible MOF material 51' is in a position that is consistent with the command position as indicated by the control stimulus 95 (610)(1). The device position rationality check 610 indicates a potential occurrence of a fault (620) when the position sensor 415 indicates the flexible MOF material 51' is in a position that is inconsistent with the command position as indicated by the control stimulus 95 (610)(0).

The MOF parameter check 612 monitors one or multiple inputs from sensor(s), and associated models, to determine a MOF parameter that is associated with structural or electrical integrity of the flexible MOF material 51' in the fuel vapor capture system 90. As described with reference to FIG. 1, MOF sensor 96 may be an electrical sensor that is arranged to monitor electrical conductance or electrical resistance across the flexible MOF material during the purge event. Alternatively, MOF sensor 96 may be a differential pressure sensor arranged to monitor a pressure drop across the flexible MOF material during the purge event. Alternatively, MOF sensor 96 may be a temperature sensor arranged to monitor a temperature of the flexible MOF material during the purge event. Alternatively, MOF sensor 96 may include multiple temperature sensors arranged to monitor a temperature gradient of the flexible MOF material during the purge event. The MOF parameter check 612 indicates absence of a fault (630) associated with the structural or electrical integrity of the flexible MOF material when a parameter associated with a signal output from the MOF sensor 96 is within a predetermined calibrated range (612)(1). The MOF parameter check 612 indicates a potential occurrence of a fault (620) when the MOF sensor 96 indicates the flexible MOF material is outside the predetermined calibrated range (612)(0).

The purge rationality check 614 monitors a time associated with a purge event in one embodiment. Purge time relates to an expected amount of time that is necessary to purge the fuel vapor capture system 90 and may be related to feedback from the exhaust sensor 19 or other information. A purge time fault may indicate a leak in the system, a fault or degradation in the flexible MOF material 51, etc. The purge rationality check 614 indicates absence of a fault (630) associated with the fuel vapor capture system 90 when the purge time is within a predetermined calibrated time range (614)(1). The purge rationality check 614 indicates a potential occurrence of a fault (620) when the purge time is outside the predetermined calibrated time range (614)(0).

The vapor flow rationality check 616 monitors a parameter associated with engine air/fuel ratio control using feedback from the exhaust sensor 19 during a purge event in one embodiment. The parameters associated with engine air/fuel ratio control relate to an expected adjustment to engine air/fuel ratio control to compensate for flow of hydrocarbon vapor from the fuel vapor capture system 90 during the purge event. The vapor flow rationality check 616 may indicate a leak in the system, a fault or degradation in the flexible MOF material 51, etc. The vapor flow rationality check 616 indicates absence of a fault (630) associated with the fuel vapor capture system 90 when the parameter associated with engine air/fuel ratio control is within a predetermined calibrated time range (616)(1). The vapor flow rationality check 616 indicates a potential occurrence of a fault (620) when the purge time is outside the predetermined calibrated time range (616)(0).

The airflow diverter position check 618 monitors a parameter associated with position of the airflow diverter 97 in response to a command from the controller 80 during a purge event in one embodiment. The airflow diverter position check 618 may indicate a fault in the airflow diverter 97 when a position of the airflow diverter 97 is inconsistent with a commanded position for the airflow diverter (618)(0). The airflow diverter position check 618 indicates absence of a fault (630) associated with the airflow diverter 97 when a position of the airflow diverter 97 is consistent with a commanded position for the airflow diverter (618)(1).

The concepts described herein may improve adsorption of gasoline/ethanol vapors by controlling MOF for best performance. The concepts described herein may improve diffusion rate to release stored gasoline/ethanol vapors by dynamically changing the MOF channel size on embodiments employing the flexible MOF material. The concepts described herein may improve controlled release of vapors at a rate and time when the engine and exhaust aftertreatment system are under optimum conditions to eliminate vapors. The concepts described herein may improve an ability to control airflow/fuel flow of engine to release vapors. This includes employing feedback from engine operation, coolant temperature, oil temperature and catalyst temperature to make sure things are fully warmed up prior to activating the heater for the adsorbent to start the desorption process. This includes tuning a response rate of the MOF material to engine flow, higher air/fuel flow to engine the higher desorption rate from adsorbent.

The term "controller" and related terms such as microcontroller, control, control unit, processor, etc. refer to one or various combinations of Application Specific Integrated Circuit(s) (ASIC), Field-Programmable Gate Array(s) (FPGA), electronic circuit(s), central processing unit(s), e.g., microprocessor(s) and associated non-transitory memory component(s) in the form of memory and storage devices (read only, programmable read only, random access, hard drive, etc.). The non-transitory memory component is capable of storing machine readable instructions in the form of one or more software or firmware programs or routines, combinational logic circuit(s), input/output circuit(s) and devices, signal conditioning, buffer circuitry and other components, which can accessed by and executed by one or more processors to provide a described functionality. Input/output circuit(s) and devices include analog/digital converters and related devices that monitor inputs from sensors, with such inputs monitored at a preset sampling frequency or in response to a triggering event. Software, firmware, programs, instructions, control routines, code, algorithms, and similar terms mean controller-executable instruction sets including calibrations and look-up tables. Each controller executes control routine(s) to provide desired functions. Routines may be executed at regular intervals, for example every 100 microseconds during ongoing operation. Alternatively, routines may be executed in response to occurrence of a triggering event. Communication between controllers, actuators and/or sensors may be accomplished using a direct wired point-to-point link, a networked communication bus link, a wireless link, or another communication link. Communication includes exchanging data signals, including, for example, electrical signals via a conductive medium; electromagnetic signals via air; optical signals via optical waveguides; etc. The data signals may include discrete, analog and/or digitized analog signals representing inputs from sensors, actuator commands, and communication between controllers. The term "signal" refers to a physically discernible indicator that conveys information, and may be a suitable waveform (e.g., electrical, optical, magnetic, mechanical or electromagnetic), such as DC, AC, sinusoidal-wave, triangular-wave, square-wave, vibration, and the like, that is capable of traveling through a medium.

The term 'model' refers to a processor-based or processor-executable code and associated calibration that simulates a physical existence of a device or a physical process. As used herein, the terms 'dynamic' and 'dynamically' describe steps or processes that are executed in real-time and are characterized by monitoring or otherwise determining states of parameters and regularly or periodically updating the states of the parameters during execution of a routine or between iterations of execution of the routine.

The terms "calibration", "calibrated", and related terms refer to a result or a process that correlates a desired parameter and one or multiple perceived or observed parameters for a device or a system. A calibration as described herein may be reduced to a storable parametric table, a plurality of executable equations or another suitable form that may be employed as part of a measurement or control routine.

A parameter is defined as a measurable quantity that represents a physical property of a device or other element that is discernible using one or more sensors and/or a physical model. A parameter can have a discrete value, e.g., either "1" or "0", or can be infinitely variable in value.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the claims.

What is claimed is:

1. An air intake system for an internal combustion engine, comprising:

a fuel vapor capture system disposed in an interior portion of the air intake system, the fuel vapor capture system including a flexible Metal Organic Framework (MOF) material, the flexible MOF material being reversibly controllable in a first state and a second state, the flexible MOF material configured to adsorb hydrocarbon vapor in the first state and to desorb the hydrocarbon vapor in the second state;

a controllable device integrated into the fuel vapor capture system;

a controller, operatively connected to the controllable device;

the controller including an instruction set, the instruction set being executable to:

activate the controllable device to control the flexible MOF material to the second state in response to a command to actively purge the fuel vapor capture system, determine an intake air purge flowrate and a total purge mass based upon the intake air purge flowrate, and deactivate the controllable device when the total purge mass is greater than a purge mass threshold.

2. The air intake system of claim 1, further comprising the instruction set being executable to:

monitor operation of the internal combustion engine; and command the purge of the fuel vapor capture system when the operation of the internal combustion engine indicates that the engine is in a warmed up state.

3. The air intake system of claim 2, comprising the instruction set being executable to control activation of the controllable device of the fuel vapor capture system when the operation of the internal combustion engine indicates that the engine is in a warmed up state.

4. The air intake system of claim 3, further comprising the instruction set being executable to control a magnitude of activation of the controllable device in relation to the monitored operation of the internal combustion engine.

5. The air intake system of claim 1, further comprising the instruction set being executable to monitor an activation parameter for the controllable device, and deactivate the controllable device when the activation parameter is greater than a second threshold.

6. The air intake system of claim 1, wherein the controllable device integrated into the fuel vapor capture system comprises a heating element that is arranged proximal to the flexible MOF material, wherein the instruction set being executable to activate the controllable device comprises the instruction set being executable to control the heating element in a heat generating state.

7. The air intake system of claim 6, wherein the heating element comprises one of a positive temperature coefficient (PTC) heater, a thin film heater, or a rod heater.

8. The air intake system of claim 1, wherein the instruction set is executable to determine an integrated activation energy parameter for the controllable device based upon the activation parameter; and wherein the controller is operative to detect a fault associated with the controllable device when the integrated activation energy parameter for the controllable device is either greater than an upper threshold or less than a lower threshold.

9. The air intake system of claim 1, further comprising a sensing element that is arranged to monitor an element of the fuel vapor capture system and is in communication with the controller; and further comprising the instruction set being executable to monitor the sensing element to detect a fault associated with the fuel vapor capture system.

10. The air intake system of claim 9, comprising the sensing element being arranged to monitor an electrical circuit of the fuel vapor capture system, and wherein the instruction set is executable to detect one of an open circuit or a short circuit in the electrical circuit of the fuel vapor capture system.

11. The air intake system of claim 9, comprising the sensing element being arranged to monitor a position associated with the flexible MOF material, and wherein the instruction set is executable to detect a fault in the flexible MOF material based upon the position.

12. The air intake system of claim 9, comprising the sensing element being arranged to monitor a temperature associated with the flexible MOF material, and wherein the instruction set is executable to detect a fault in the flexible MOF material based upon the temperature.

13. The air intake system of claim 9, comprising the sensing element being arranged to monitor a pressure associated with the flexible MOF material, and wherein the instruction set is executable to detect a fault in the flexible MOF material based upon the pressure.

14. The air intake system of claim 9, comprising the sensing element being arranged to monitor a purge time associated with the fuel vapor capture system, and wherein the instruction set is executable to detect a fault in the flexible MOF material based upon the purge time.

15. An air intake system for an internal combustion engine, comprising:

a fuel vapor capture system disposed in an interior portion of the air intake system, the fuel vapor capture system including a Metal Organic Framework (MOF) material, the MOF material configured to adsorb and desorb hydrocarbon fuel vapor;

a controllable device integrated into the fuel vapor capture system;

a controller, operatively connected to the controllable device;

the controller including an instruction set, the instruction set being executable to:

activate the controllable device in response to a command to actively purge the fuel vapor capture system, determine an intake air purge flowrate and a total purge mass based upon the intake air purge flowrate, and deactivate the controllable device when the total purge mass is greater than a purge mass threshold.

16. The air intake system of claim 15, wherein the controllable device integrated into the fuel vapor capture system comprises a heating element that is arranged proximal to the MOF material, wherein the instruction set being executable to activate the controllable device comprises the instruction set being executable to control the heating element in a heat generating state.

17. A method for operating an on-vehicle fuel vapor capture system arranged in an air intake system of an internal combustion engine, the fuel vapor capture system arranged to capture fuel vapors from the internal combustion engine, wherein the fuel vapor capture system is composed of a flexible Metal Organic Framework (MOF) material that is coupled to a controllable device, the method comprising:

monitoring operation of the internal combustion engine;

activating the controllable device and determining an activation parameter for the controllable device;

determining an intake air purge flowrate and a total purge mass based upon the intake air purge flowrate; and deactivating the controllable device when the total purge mass is greater than a threshold.

18. The method of claim 17, further comprising deactivating the controllable device when the activation parameter for the controllable device is greater than a second threshold.

19. The method of claim 17, wherein the controllable device includes a first heating element that is arranged proximal to the flexible MOF material, wherein the method further comprises controlling the controllable device in a heat generating state.

20. The method of claim 17, comprising integrating the activation parameter to determine an integrated activation energy parameter for the controllable device; and detecting a fault associated with the controllable device when the integrated activation energy parameter for the controllable device is either greater than an upper threshold or less than a lower threshold.

* * * * *